US011920362B2

(12) United States Patent
Breton

(10) Patent No.: US 11,920,362 B2
(45) Date of Patent: Mar. 5, 2024

(54) BASKETBALL HOOP POLE HOLDER

(71) Applicant: GESTION LOGISCASA INC., Quebec (CA)

(72) Inventor: Daniel Breton, Quebec (CA)

(73) Assignee: GESTION LOGISCASA INC., Quebec (CA)

( * ) Notice: Subject to any disclaimer, the term of this patent is extended or adjusted under 35 U.S.C. 154(b) by 0 days.

(21) Appl. No.: 17/292,163

(22) PCT Filed: Nov. 20, 2018

(86) PCT No.: PCT/CA2018/000227
§ 371 (c)(1),
(2) Date: May 7, 2021

(87) PCT Pub. No.: WO2019/241870
PCT Pub. Date: Dec. 26, 2019

(65) Prior Publication Data

US 2021/0388631 A1 Dec. 16, 2021

(51) Int. Cl.
*E04H 12/22* (2006.01)
*A63B 71/02* (2006.01)

(52) U.S. Cl.
CPC ..... *E04H 12/2284* (2013.01); *E04H 12/2223* (2013.01); *E04H 12/2269* (2013.01); *A63B 2071/024* (2013.01); *A63B 2209/00* (2013.01)

(58) Field of Classification Search
CPC ..... E04H 12/2284; E04H 12/2223; E04H 12/2269; A63B 2071/024
(Continued)

(56) References Cited

U.S. PATENT DOCUMENTS 209,187 A * 10/1878 Patterson ..... A01K 97/10 248/515
336,363 A * 2/1886 Ward ..... A01K 97/10 248/515

(Continued)

FOREIGN PATENT DOCUMENTS

CA 2573995 A1 * 4/2008 ..... E04H 17/22
WO WO-2018227265 A1 * 12/2018 ..... E04H 12/2269

OTHER PUBLICATIONS

WO PCT/CA2018/000227—ISR.
WO PCT/CA2018/000227—WO.

*Primary Examiner* — Kimberly T Wood
(74) *Attorney, Agent, or Firm* — Agence de Brevets Fournier

(57) ABSTRACT

A holder for a pole of a basketball hoop system includes a pole sleeve for receiving the pole, a tightening system for securing the pole into the pole sleeve in a solidary relationship, and a mounting bracket to secure the pole sleeve to a ground directly or via a stake. The pole holder includes a first mounting element defining a first mounting surface for securing the mounting bracket to the ground in a generally parallel relationship, and a second mounting element that is fixedly mountable to the first mounting element and that defines a second mounting surface for fixedly receiving the pole sleeve in a generally parallel relationship, such that the pole sleeve is offset from the first mounting surface. The first and second mounting elements can be assembled within a first range of relative angular positions therebetween about a first axis that is generally parallel to the first mounting surface, and the pole sleeve and second mounting element can be assembled within a second range of relative angular positions therebetween about a third axis that is generally perpendicular to the second mounting surface and to the second axis.

28 Claims, 14 Drawing Sheets

(58) Field of Classification Search
USPC ..... 248/530, 156, 514, 523, 524, 527, 528, 248/532, 533, 511, 518, 519, 529, 539, 248/278.1, 183.2
See application file for complete search history.

(56) References Cited

U.S. PATENT DOCUMENTS 462,265 A * 11/1891 Mason ..... A01K 97/10 135/90
1,266,367 A * 5/1918 Wilson ..... A01K 87/08 5/646
1,283,511 A * 11/1918 Heidtmann ..... B60R 13/00 248/541
2,430,112 A * 11/1947 Hamre ..... A01K 97/10 248/515
2,481,717 A * 9/1949 Blair ..... F16M 11/2014 248/183.2
2,502,684 A * 4/1950 Ward ..... A01K 97/10 248/515
2,540,584 A * 2/1951 Ellsworth ..... A01K 97/10 248/515
2,580,130 A * 12/1951 Rowdon ..... A01K 87/06 43/21.2
2,734,708 A * 2/1956 Cohn ..... H01Q 1/084 248/517
3,185,416 A * 5/1965 Osinski ..... A47G 33/12 248/527
3,224,716 A * 12/1965 Eville ..... H01Q 1/084 248/514
4,560,129 A * 12/1985 Clayton ..... F16M 11/10 248/278.1
5,109,411 A * 4/1992 O'Connell ..... B60R 11/0241 224/553
5,198,830 A * 3/1993 Lin ..... H01Q 1/125 248/183.2
5,285,938 A * 2/1994 Fauchald ..... B60R 11/0241 224/482
5,404,682 A 4/1995 West
5,445,355 A * 8/1995 Chen ..... H01Q 1/088 343/715
6,264,152 B1 * 7/2001 Bloch ..... F16M 11/126 248/274.1
6,535,177 B1 * 3/2003 Dhellemmes ..... H01Q 1/084 343/765
6,864,855 B1 * 3/2005 Fujita ..... H01Q 19/17 343/840
6,953,180 B1 * 10/2005 Ruvalcaba ..... E04H 12/2215 135/118
7,603,960 B1 * 10/2009 Perry ..... B63B 21/04 114/218
7,737,900 B1 * 6/2010 Saindon ..... H01Q 1/125 343/760
7,954,777 B2 * 6/2011 Bohm ..... F16M 11/10 248/278.1
8,020,824 B2 * 9/2011 Pan ..... H01Q 1/1207 248/299.1
8,451,187 B2 * 5/2013 Zihlman ..... H01Q 3/08 343/882
9,172,137 B2 * 10/2015 Lee ..... H01Q 1/125
9,966,649 B2 * 5/2018 Christie ..... H01Q 1/125
9,968,167 B2 * 5/2018 Volin ..... F16B 7/182
10,228,002 B2 * 3/2019 Fletcher ..... F16B 2/10
10,476,129 B2 * 11/2019 Woodling ..... H01Q 1/1228
2002/0084396 A1 * 7/2002 Weaver ..... F16M 11/10 248/278.1
2005/0264467 A1 * 12/2005 Lin ..... H01Q 3/08 343/882
2005/0279897 A1 * 12/2005 Callies ..... A47K 1/00 248/218.4
2006/0181477 A1 * 8/2006 Lin ..... H01Q 1/125 343/880
2007/0074446 A1 * 4/2007 Wilcox ..... A01K 91/08 43/21.2
2007/0132655 A1 * 6/2007 Lin ..... H01Q 1/125 343/880
2008/0165076 A1 * 7/2008 Pan ..... H01Q 1/125 343/882
2008/0277551 A1 * 11/2008 Hackney ..... E04B 7/045 248/276.1
2009/0061761 A1 * 3/2009 Yang ..... H01Q 1/1264 455/3.02
2009/0072108 A1 * 3/2009 Oleson ..... F04D 25/088 248/282.1
2011/0006968 A1 * 1/2011 Morrow ..... H01Q 1/084 343/882
2011/0260029 A1 * 10/2011 Kost ..... A45B 25/08 248/514
2012/0043448 A1 * 2/2012 Liao ..... F16M 11/2014 248/534
2012/0192507 A1 * 8/2012 Paananen ..... E04H 17/22 52/155
2012/0234992 A1 * 9/2012 Vanover ..... F16M 11/2021 248/201
2015/0047445 A1 * 2/2015 Yang ..... F16B 35/048 74/89.39
2015/0083875 A1 * 3/2015 Lloyd ..... H01Q 1/1228 248/218.4
2015/0259943 A1 * 9/2015 Paananen ..... E04H 12/2269 52/159
2017/0295895 A1 * 10/2017 Volin ..... A45B 19/00
2017/0301265 A1 * 10/2017 Kyle ..... G09F 7/18

* cited by examiner

BASKETBALL HOOP POLE HOLDER

FOREIGN PRIORITY CLAIM

This is a 35 U.S.C. § 371 application of, and claims priority to International Application No. PCT/CA2018/000227, which was filed on Nov. 20, 2018, and published as Publication No. WO 2019/241870A1, the entirety of which is incorporated herein by reference.

FIELD

The present disclosure relates to sports equipment. More specifically, the present disclosure concerns portable street basketball hoop systems.

BACKGROUND

There are currently two types of outdoor basketball hoop systems: inground and portable systems.

Fixed basketball hoop systems include a basket on a backboard that is secured directly on a structure such as an outside wall or that hang on a pole that is permanently secured into the ground. While a fixed installation is stable and safe, its installation cost is high, and it must be positioned in a dedicated area, for example inside a lot. It is therefore not suitable for street play and more generally lacks mobility.

A typical portable basketball hoop system 10 is shown in FIG. 1. The system 10 has a backboard 12 secured to a pole 14, that is in turn fixedly mounted to a plastic base 16 that is intended to be filled with water, sands or the likes to increase its weight and therefore its stability. The resulting assembly partly solved the drawback of fixed installation by being able to be carried from one place to another. However, drawbacks of such a portable basketball hoop system include its bulkiness, the fragility of its base 16, its instability in strong winds, the inherent tradeoff between its stability and portability, and the difficulty to level such a system.

Other portable systems are known that include a fixation mechanism for receiving the basketball hoop pole and removably mounting it to a structure. However, none of such systems has been found to be adapted for securing the pole directly to the ground while allowing its vertical alignment to be adjusted. Also, none of the know systems allows the mounting of the pole to be sufficiently rigid, and more generally to withstand all playing exigence, including withstanding the weight of a player hung to the hoop.

SUMMARY

According to an illustrative embodiment, there is provided a holder for a pole comprising:

a pole sleeve for receiving the pole; the pole sleeve defining a first axis;

a tightening system for securing the pole into the pole sleeve in a solidary relationship between the pole and the pole sleeve; and an adjustable mounting bracket having:

a first mounting element defining a first mounting surface for mounting the adjustable mounting bracket to another surface in a generally parallel relationship, and a second mounting element being fixedly mountable to the first mounting element within a first range of relative angular positions therebetween about a second axis that is generally parallel to the first mounting surface; the second mounting element defining a second mounting surface for fixedly receiving the pole sleeve in a generally parallel relationship within a second range of relative angular positions therebetween about a third axis that is generally perpendicular to the second mounting surface and to the second axis.

According to another illustrative embodiment, there is provided a holder for a pole comprising:

a pole sleeve for receiving the pole;

a tightening system for securing the pole into the pole sleeve in a solidary relationship between the pole and the pole sleeve; and a mounting bracket including:

a first mounting element having a first mounting portion for mounting the mounting bracket to a surface in a generally parallel relationship between the first mounting portion and the surface, and a second mounting element secured to the first mounting element and having a second mounting portion that is generally perpendicular to the first mounting portion for fixedly receiving the pole sleeve in a generally parallel relationship between the pole sleeve and the second mounting portion, such that the pole sleeve is offset from the first mounting surface.

According to still another illustrative embodiment, the is provided a holder for a pole comprising:

a pole sleeve for receiving the pole; the pole sleeve defining a first axis;

a tightening system for securing the pole into the pole sleeve in a solidary relationship between the pole and the pole sleeve; and an adjustable mounting bracket including:

a first mounting element having a first mounting portion for mounting the mounting bracket to a surface in a generally parallel relationship between the first mounting portion and the horizontal surface;

a stake for insertion into a ground; the stake defining a second axis and having a mounting surface that is generally perpendicular to the second axis for receiving the first mounting portion of the adjustable mounting bracket; and a second mounting element being fixedly mountable to the first mounting element within a first range of relative angular positions therebetween about a third axis that is generally parallel to the first mounting portion and generally perpendicular to the second axis; the second mounting element defining a second mounting portion for fixedly receiving the pole sleeve in a generally parallel relationship within a second range of relative angular positions therebetween about a fourth axis that is generally perpendicular to the second mounting surface and to the third axis; the pole sleeve being offset from the first mounting portion.

Such pole holders are easy and quick to install on an outdoor ground or on any horizontal surface sur as a floor and as easy to remove to be stored or to be moved to another location.

Such pole holders are well adapted to fix a basketball hoop pole to the ground.

The use of an illustrative embodiment of a holder as described herein results in a basketball hoop system installation that is as rigid and safe as a permanent installation with, however, the advantages of being a removable and transportable system.

It is to be noted that the expression "removable" is to be construed in the description and in the claims as being able and intended to be installed and uninstall repeatedly.

It is to be noted that the expression "solidarily joined" should be construed in the description and in the claims so as to characterize elements that are integrally joined or whose joining is so rigid as to act as if the parts were effectively integral.

Other objects, advantages and features of the pole holder will become more apparent upon reading the following non-restrictive description of preferred embodiments thereof, given by way of example only with reference to the accompanying drawings.

DETAILED DESCRIPTION

Figure 1:
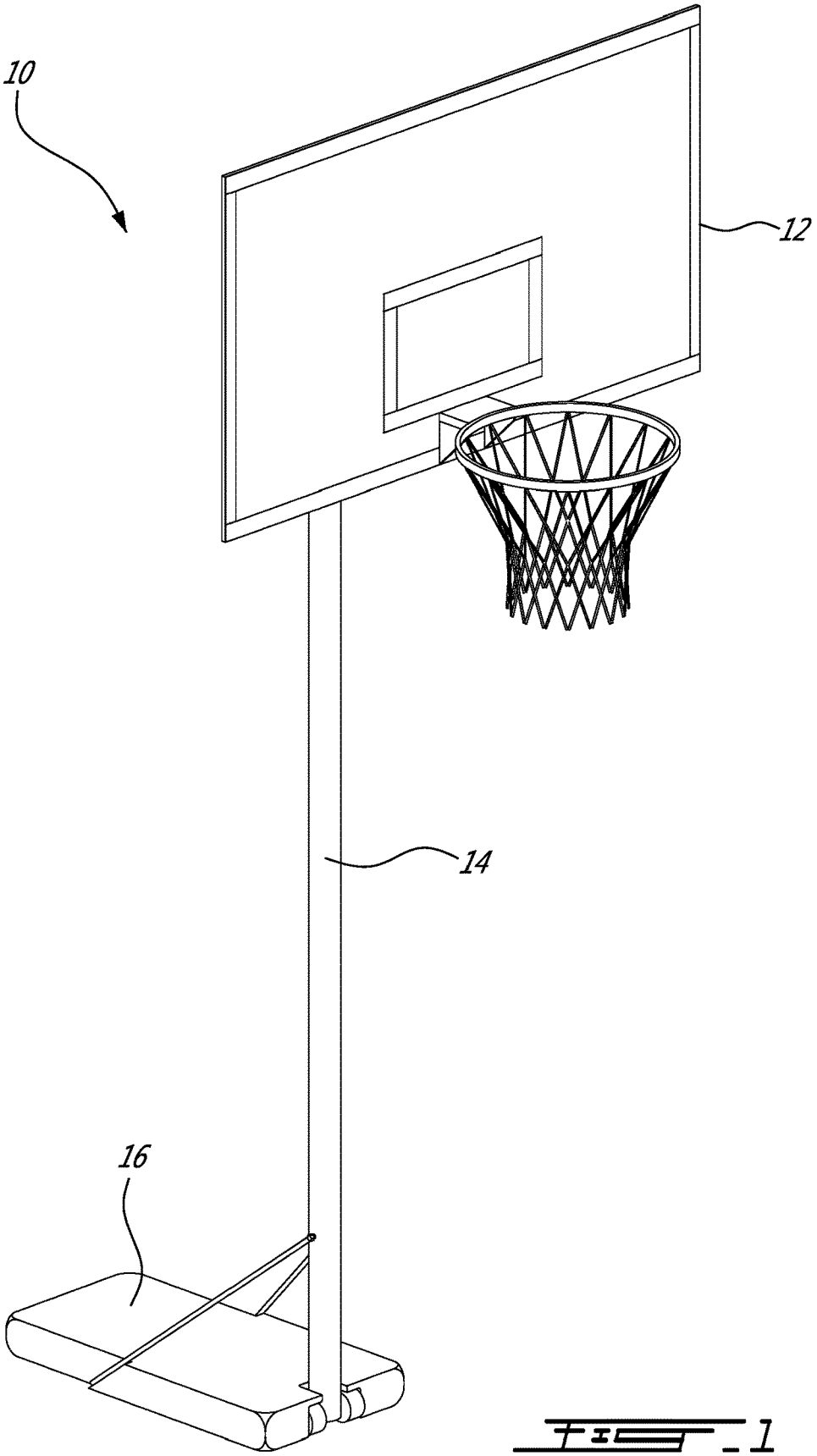
FIG. 1 (PRIOR ART)
FIG. 1, which is labelled "Prior Art" is a perspective view of a portable basketball hoop system according to the prior art.

In the following description, similar features in the drawings have been given similar reference numerals, and in order not to weigh down the figures, some elements are not referred to in some figures if they were already identified in a precedent figure.

The use of the word "a" or "an" when used in conjunction with the term "comprising" in the claims and/or the specification may mean "one", but it is also consistent with the meaning of "one or more", "at least one", and "one or more than one". Similarly, the word "another" may mean at least a second or more.

As used in this specification and claim(s), the words "comprising" (and any form of comprising, such as "comprise" and "comprises"), "having" (and any form of having, such as "have" and "has"), "including" (and any form of including, such as "include" and "includes") or "containing" (and any form of containing, such as "contain" and "contains"), are inclusive or open-ended and do not exclude additional, unrecited elements.

Figure 2:
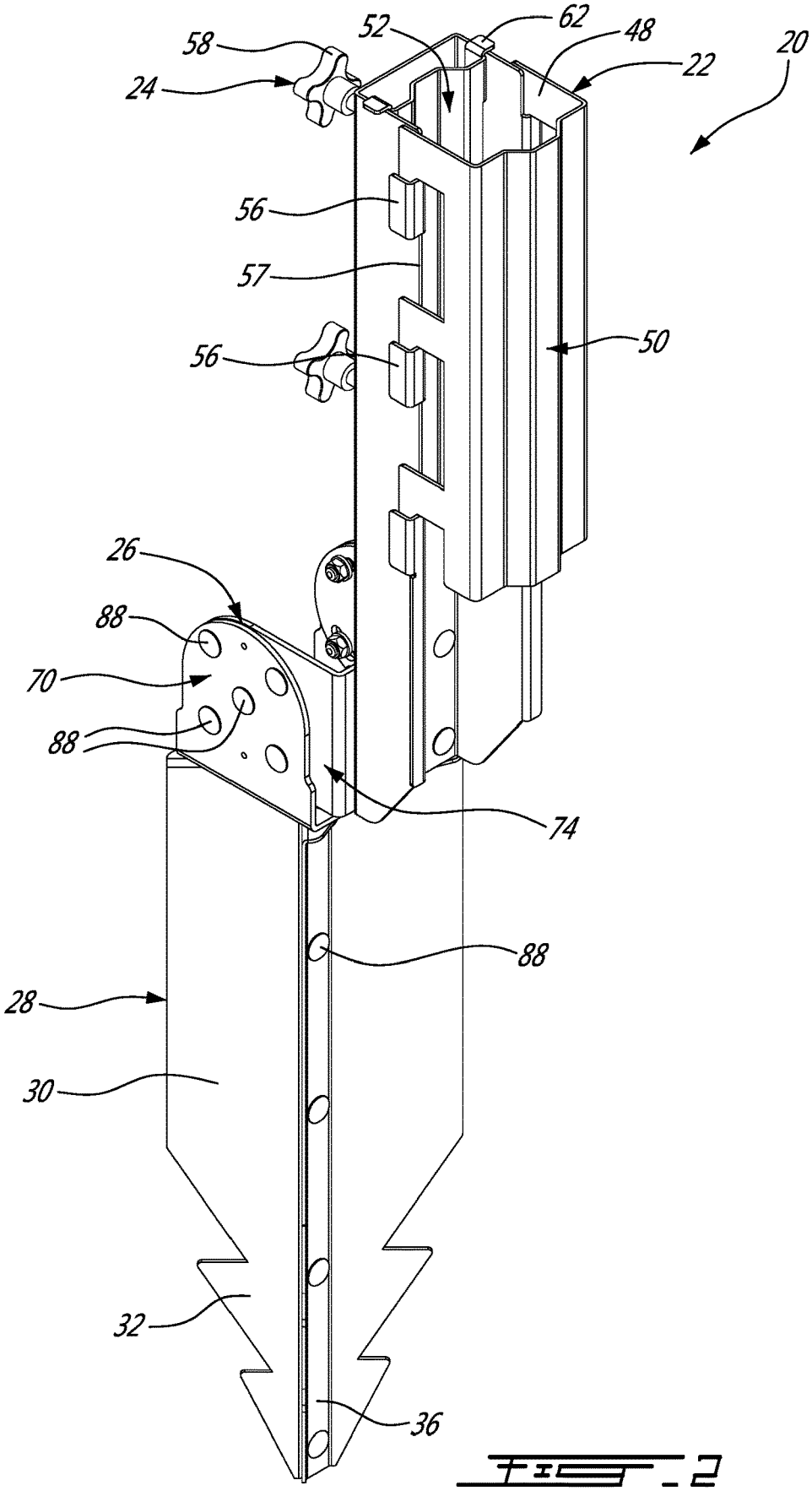
FIG. 2 is a front perspective view of a basketball hoop pole holder according to a first illustrative embodiment.
Figure 3:
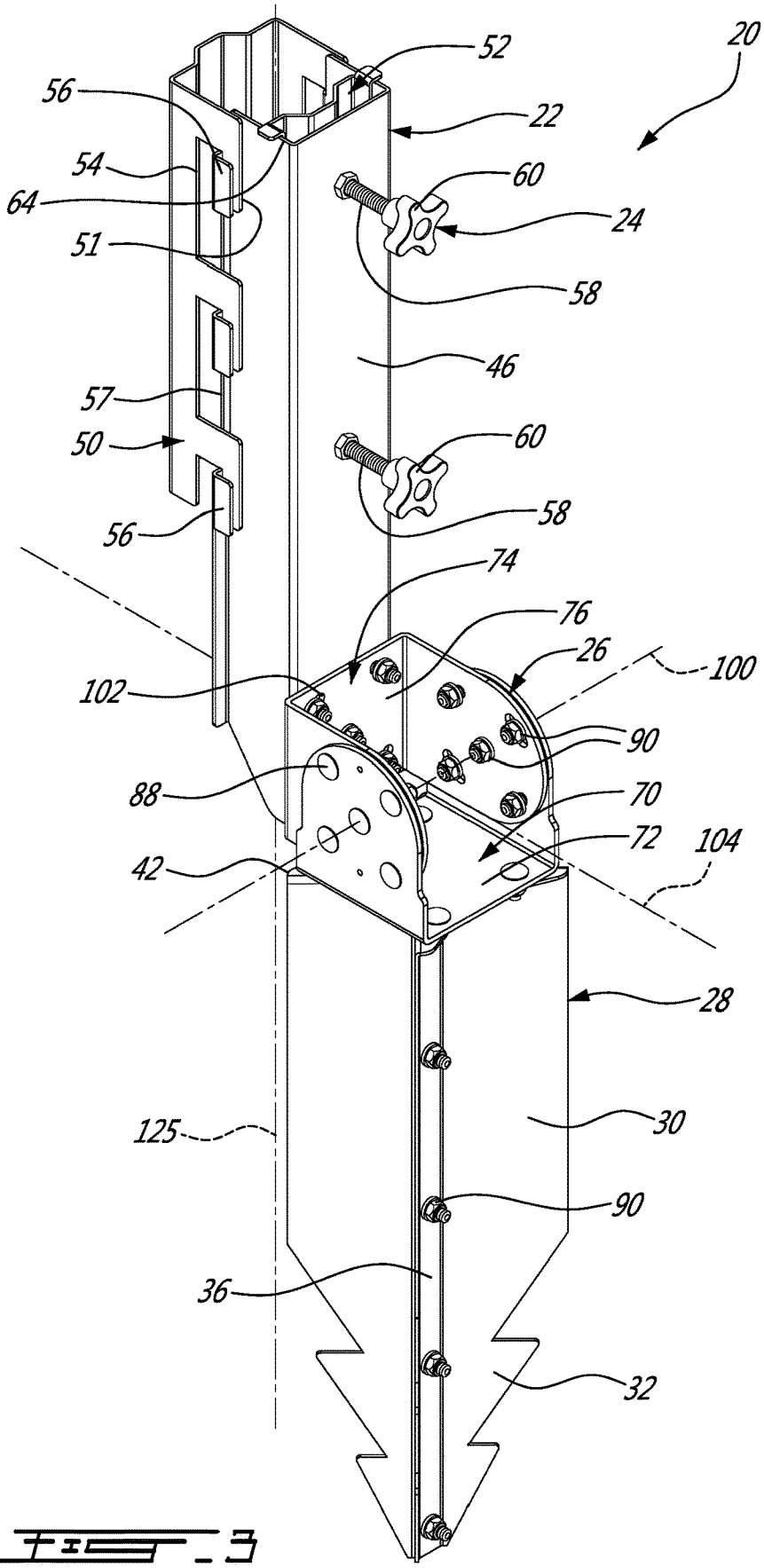
FIG. 3 is a back perspective view of the basketball hoop pole holder from FIG. 2.
Figure 4:
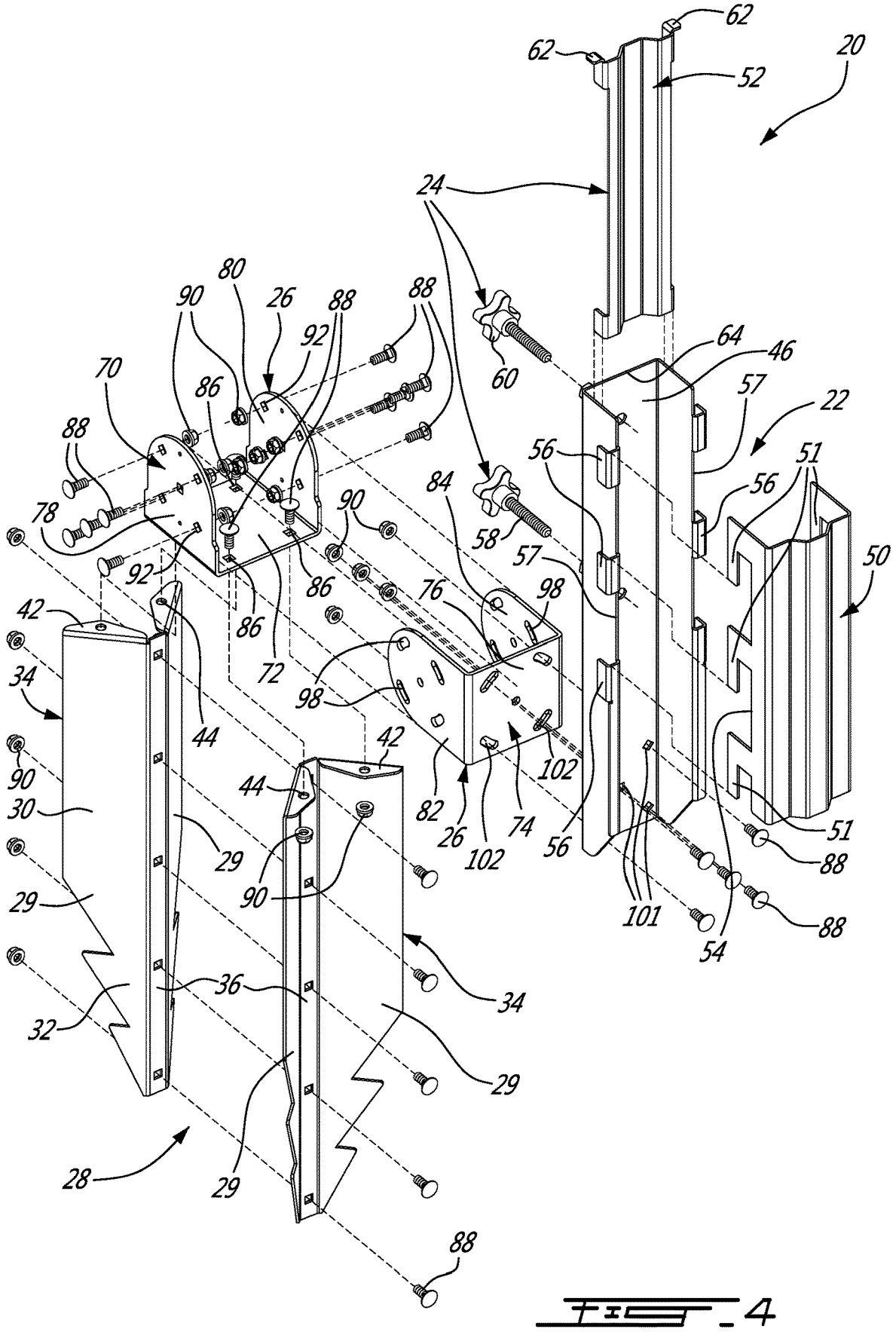
FIG. 4 is an exploded view of the basketball hoop pole holder from FIG. 2.

A removable basketball hoop pole holder 20 according to a first illustrative embodiment will be described with reference first to FIGS. 2 to 4.

The pole holder 20 comprises i) a pole sleeve 22, including a pole tightening system 24, ii) an adjustable bracket 26 and iii) a ground-mounting stake 28.

The stake 28 has a cross-shaped cross-section with each of its four (4) legs 29 having a proximate portion 30 that is straight and a tapered serrated distal portion 32. The stake 28 is assembled from two identical half portions 34. Each half portion 34 includes two of the legs 29 that are relatively positioned at a 90 degrees angle and that are joined longitudinally via a narrow band 36. The two halves 34 are assembled together via their respective narrow bands 36 using fasteners such as bolts 88 and nuts 90. A triangular fold 42 is provided at the proximate end of each leg 29, which is provided with a fastener-receiving hole 44. The folds 42 together define a receiving surface for the bracket 26 when the two halves are assembled, as will be described hereinbelow in more detail.

Figure 5A:
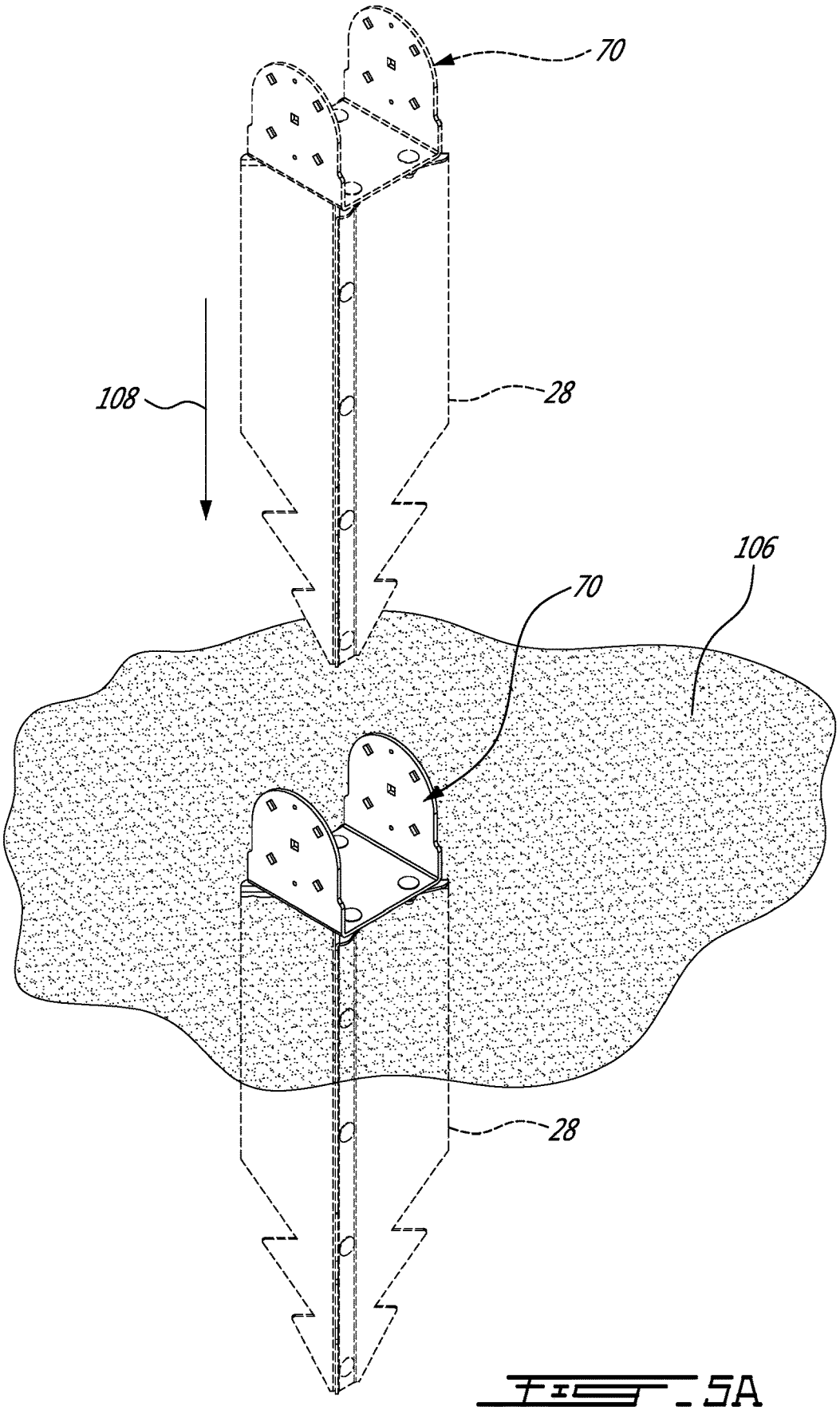
FIGS. 5A to 5H are perspective views of the basketball hoop pole holder from FIG. 2, illustrating the installation thereof to mount a basketball hoop pole to the ground.

The stake 28 is configured to be easily inserted in the ground (see FIG. 5A).

It has been found that a rigid stake 28 having a length of about 26 inches (66.0 cm) and a width of 7 inches (17.8 cm) is sufficient to act as a stable anchor in most ground for the pole holder 20 with backboard 12, and this under any normal playing condition.

The configuration of the stake 28 is not limited to the illustrated embodiment. It can have another shape or be made of another material than described hereinabove. The stakes 28 can also be omitted, as will be described hereinbelow in more detail.

As will also be described hereinbelow in more detail, the pole sleeve 22 is mounted to the stake 28 via the adjustable bracket 26.

The pole sleeve 22 includes i) an open channel 46 defining a longitudinal opening 48 for allowing insertion of the basketball hoop pole 14 in the sleeve 22, and a removable cover 50 that cooperates with the open channel 46 to close the longitudinal opening 48.

The cover 50 is in the form of an elongated plate that is bent to a concave shape. The configuration and length of the cover 50 is such that it complementary closes the opened lateral side of the open channel 46 when they are assembled. For that purpose, the cover 50 includes integral tabs 51 on both its lateral edges 54. Each tab 51 includes a portion laterally distanced from the respective lateral side edges 54 that defines a hook. The tabs 51 are configured and shaped for insertion in corresponding lodgings 56 provided on both lateral sides 57 of the open channel 46 of the pole sleeve 22. More specifically, the lodgings 56 are in the form of L-shaped elements extending from the channel 46.

According to another embodiment (not shown), other cooperating elements than tabs 51 and L-shaped elements 56 can be provided to removably attach the cover 50 to the channel 46, including without limitations fasteners, a hinge with clips, etc.

According to still another embodiment (not shown), the pole sleeve cover 50 includes a plurality of sections, each removably attached to the channel 46.

The tightening system 24 comprises a couple of clamping screws 58 provided with a handle 60 operatively mounted to the open channel 46 so as to extend in the opening thereof 48, and a pressure plate 52 that is insertable in the opening of the channel 46, between a pole 14 (see for example FIG. 5G) inserted in the sleeve 22 and the channel 46.

The pressure plate 52 is in the form of an elongated plate that is bent to a concave shape. The plate 52 includes mechanical stops 62 in the form of folded portions of the plate 52 that lies in a plane generally perpendicular to the general plane thereof. The stops 62 are configured and positioned to contact the free edge 64 of the open channel 46 during the insertion of the pressure plate 52 therein. This allows forcing the alignment of the plate 52 with the channel 46 therealong.

Figure 5B:
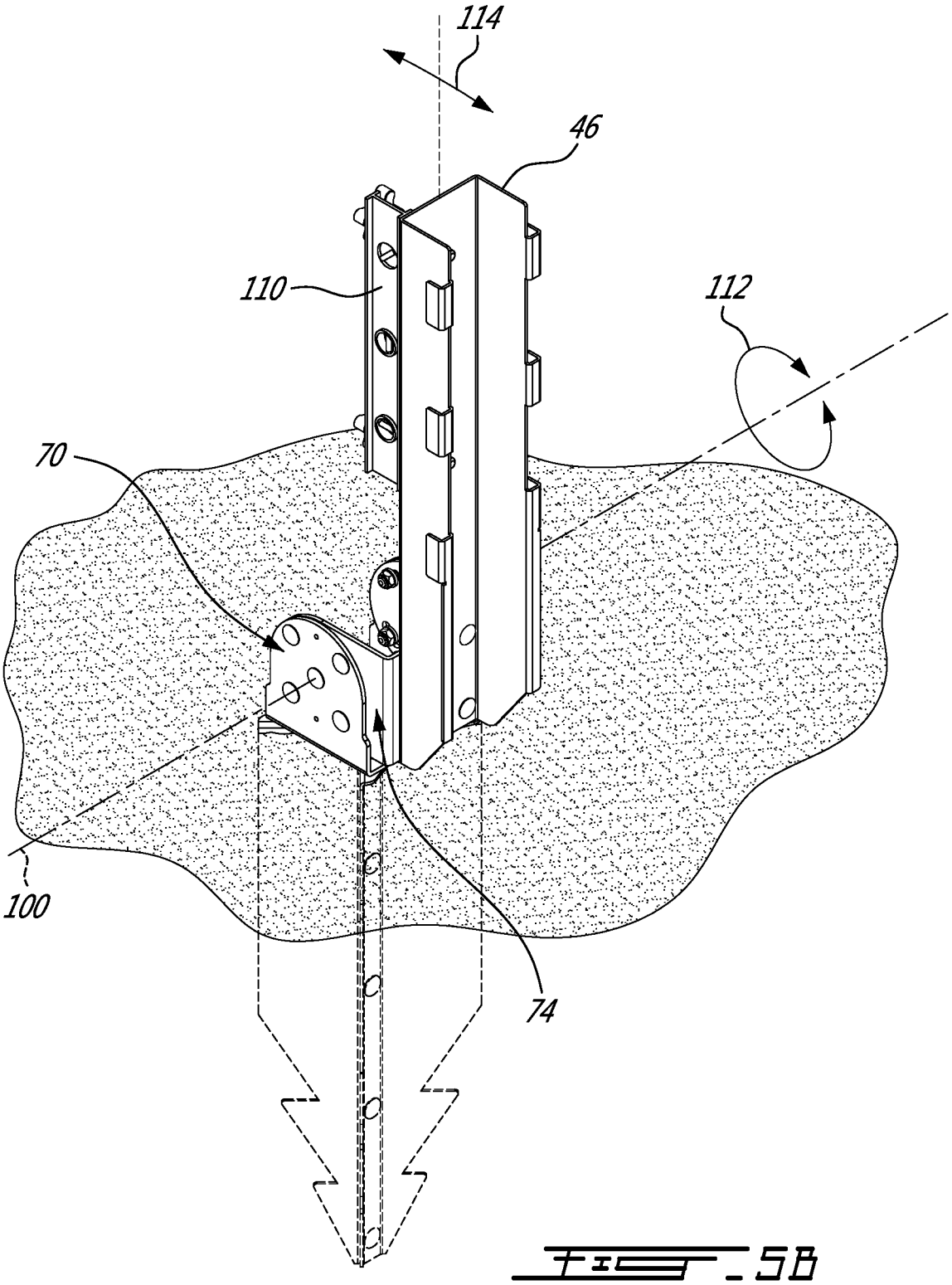
Figure 5C:
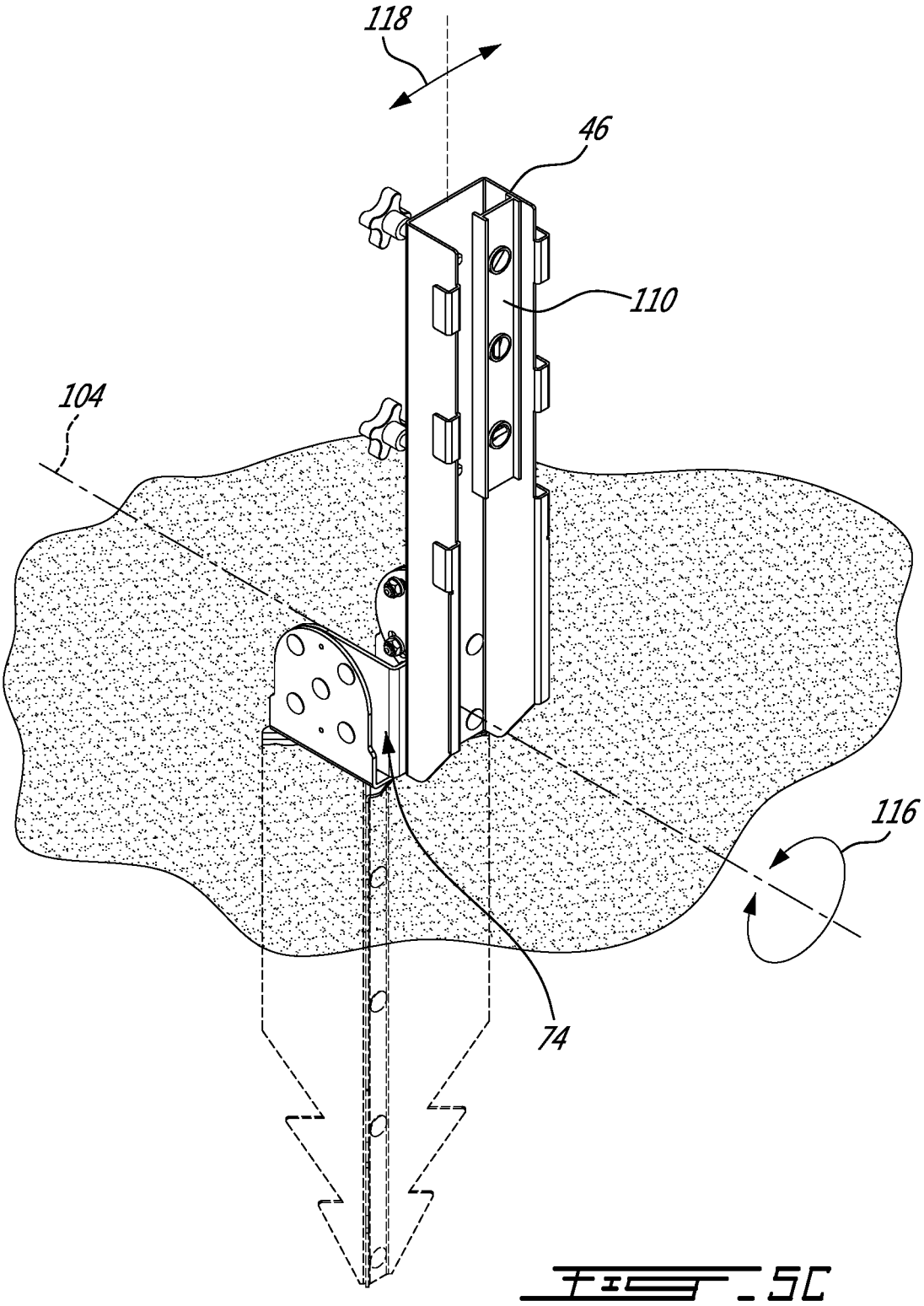
Figure 5D:
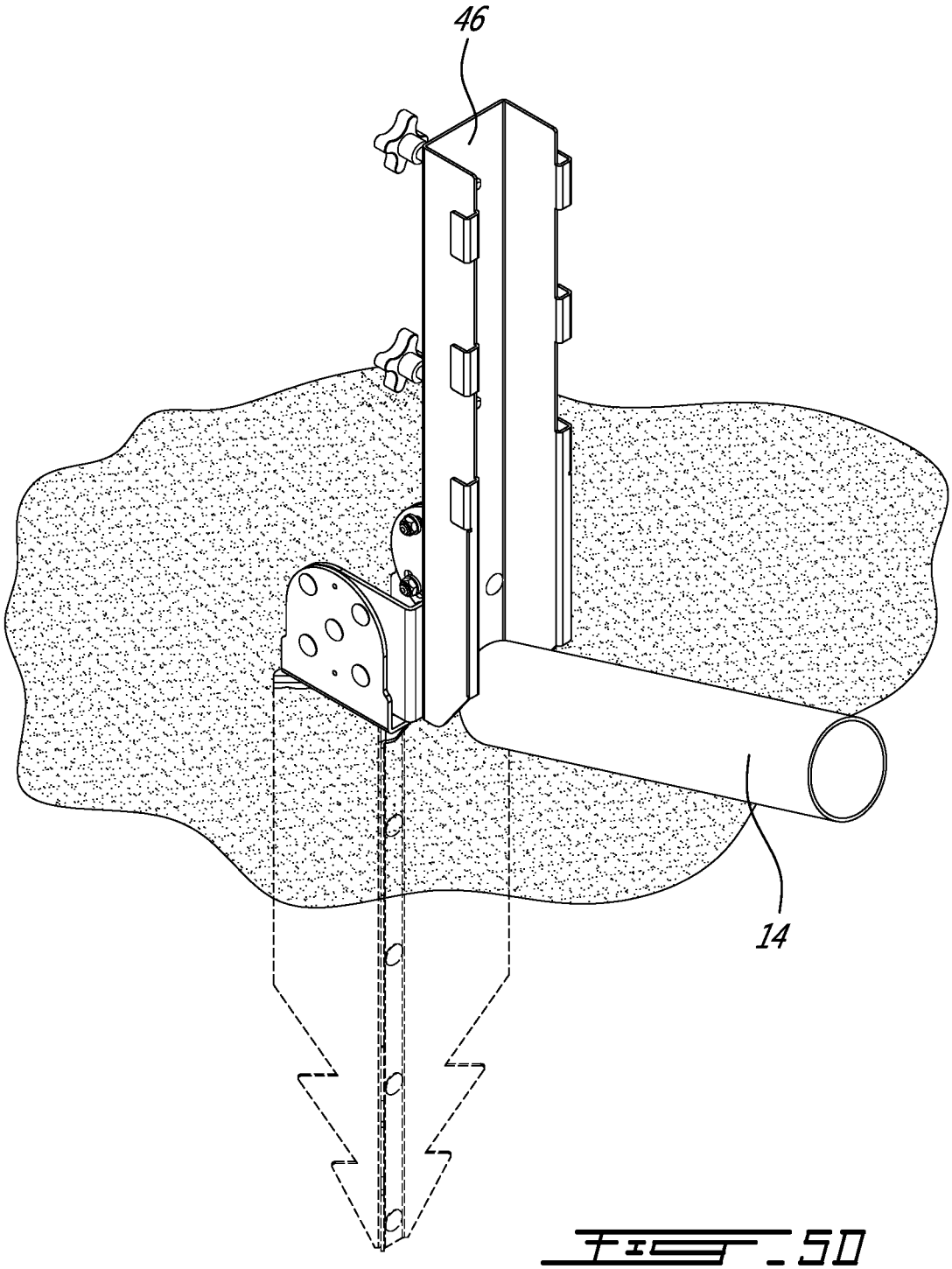
Figure 5E:
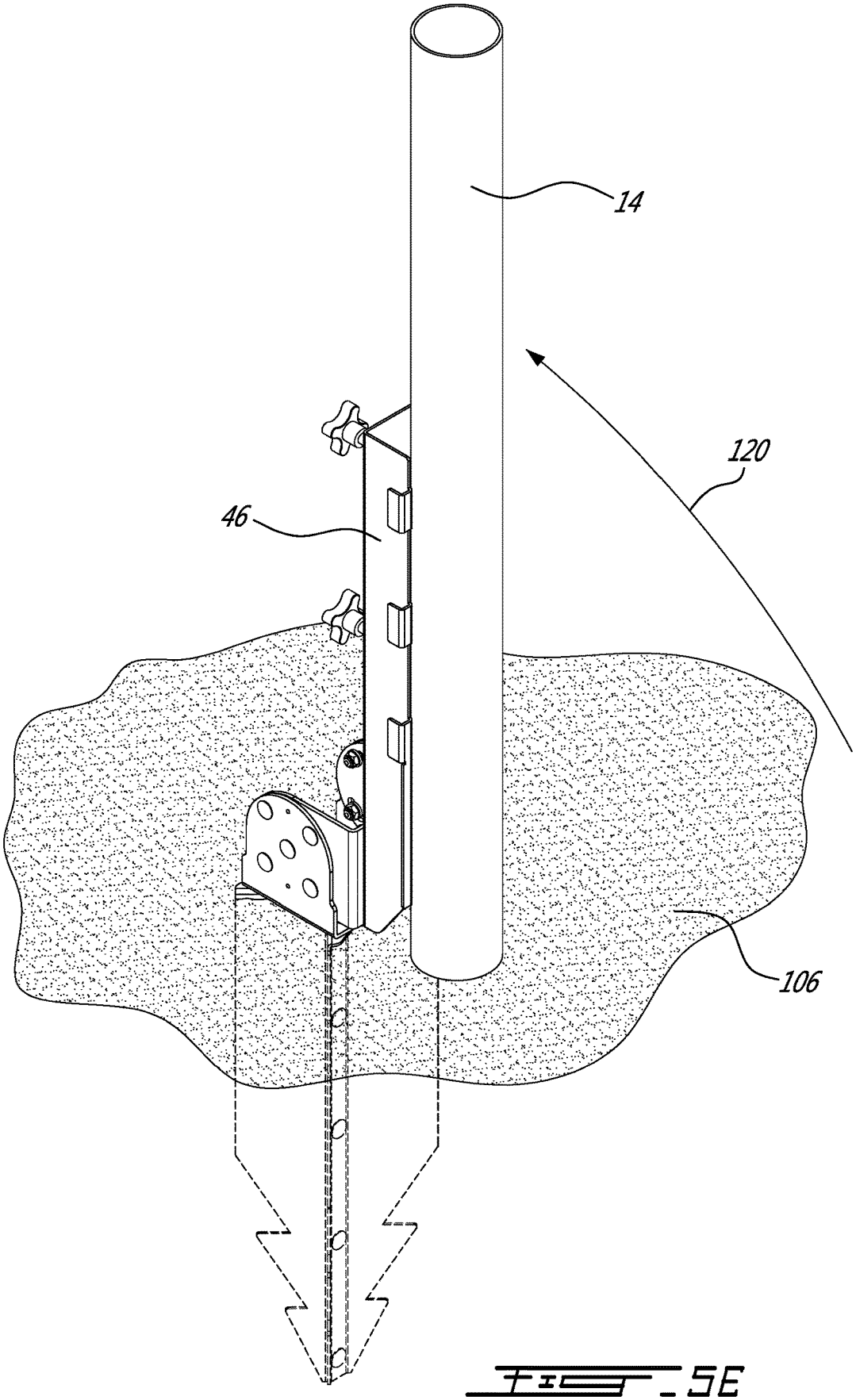
Figure 5F:
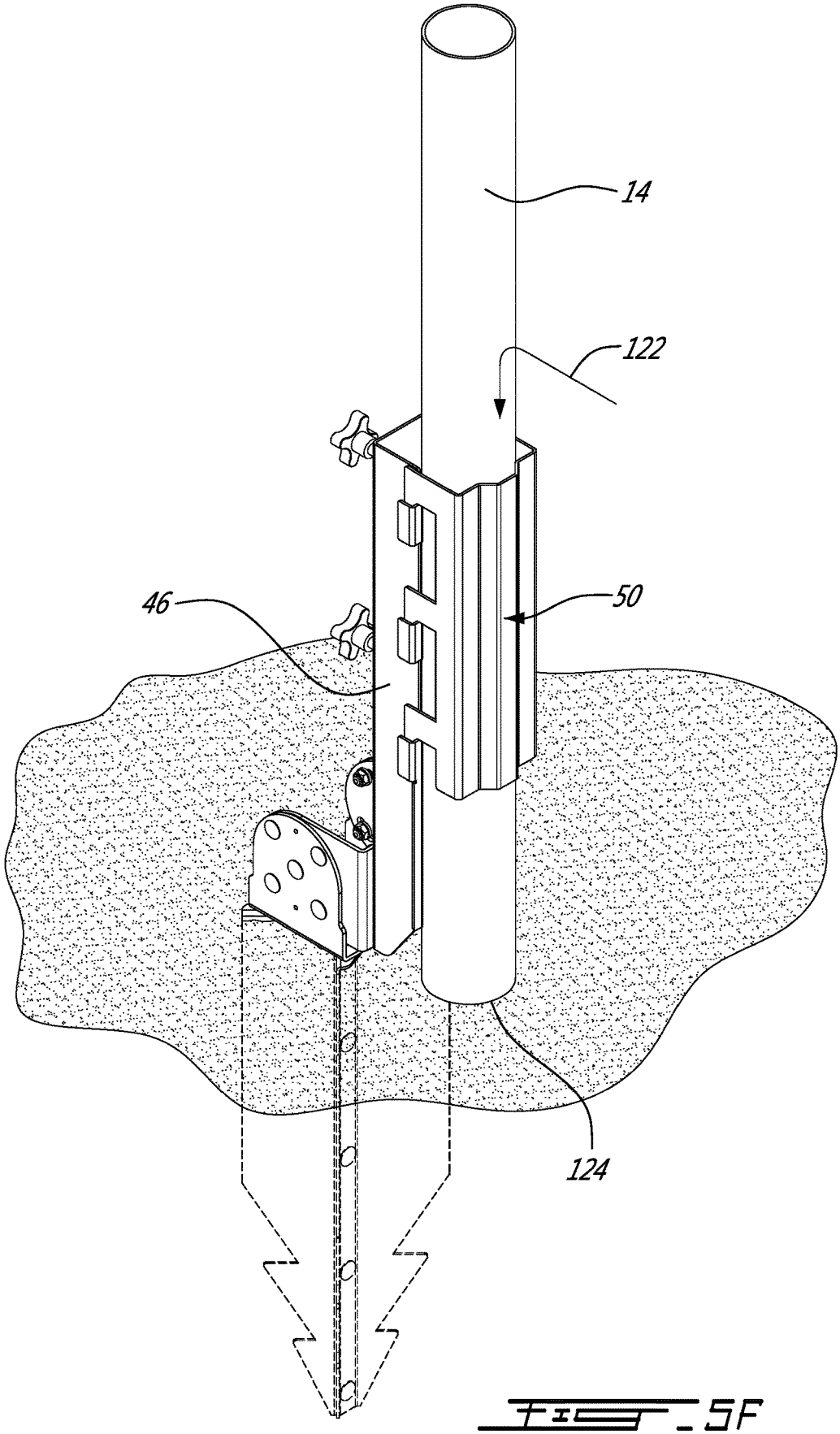
Figure 5G:
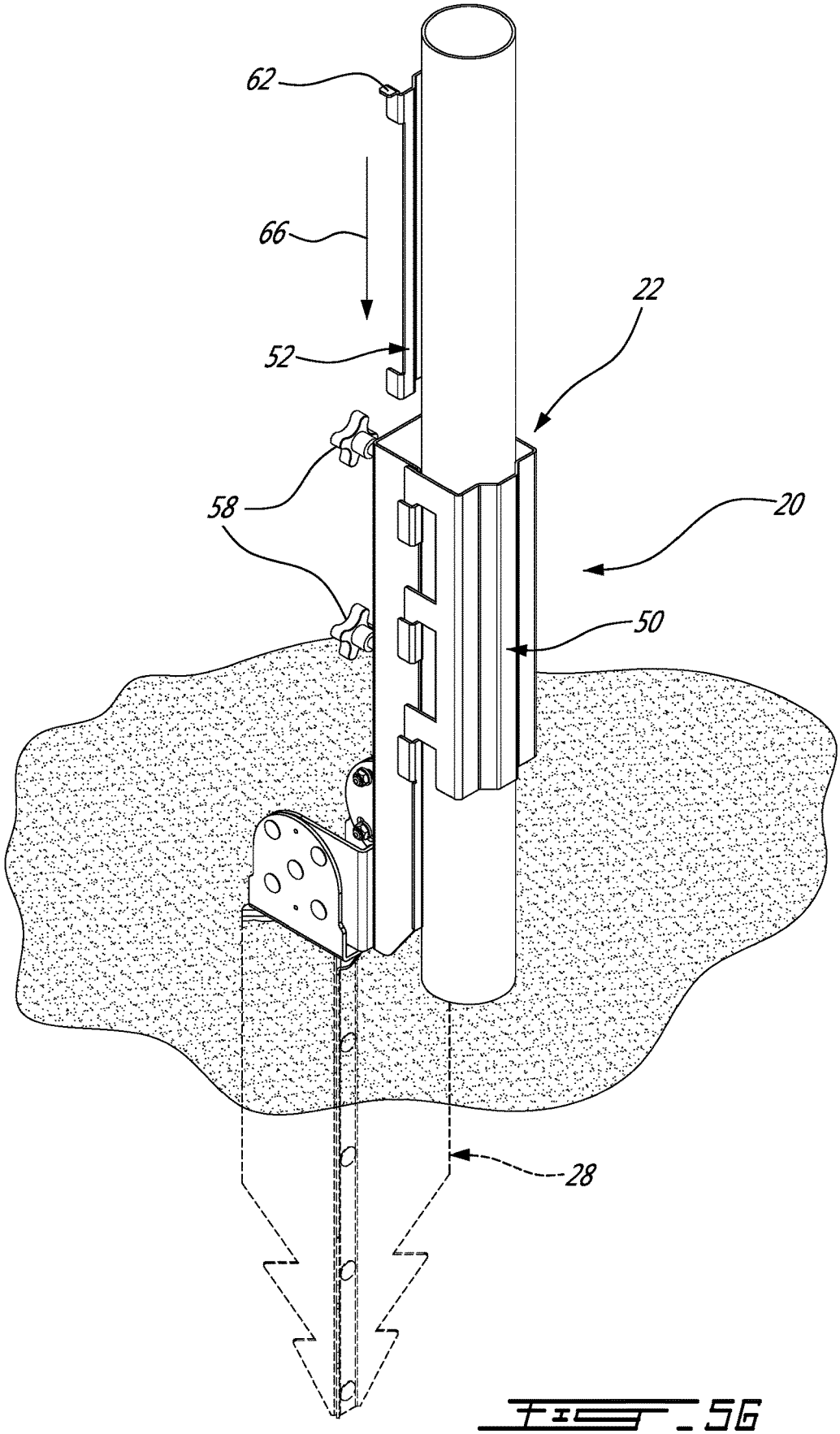
Figure 5H:
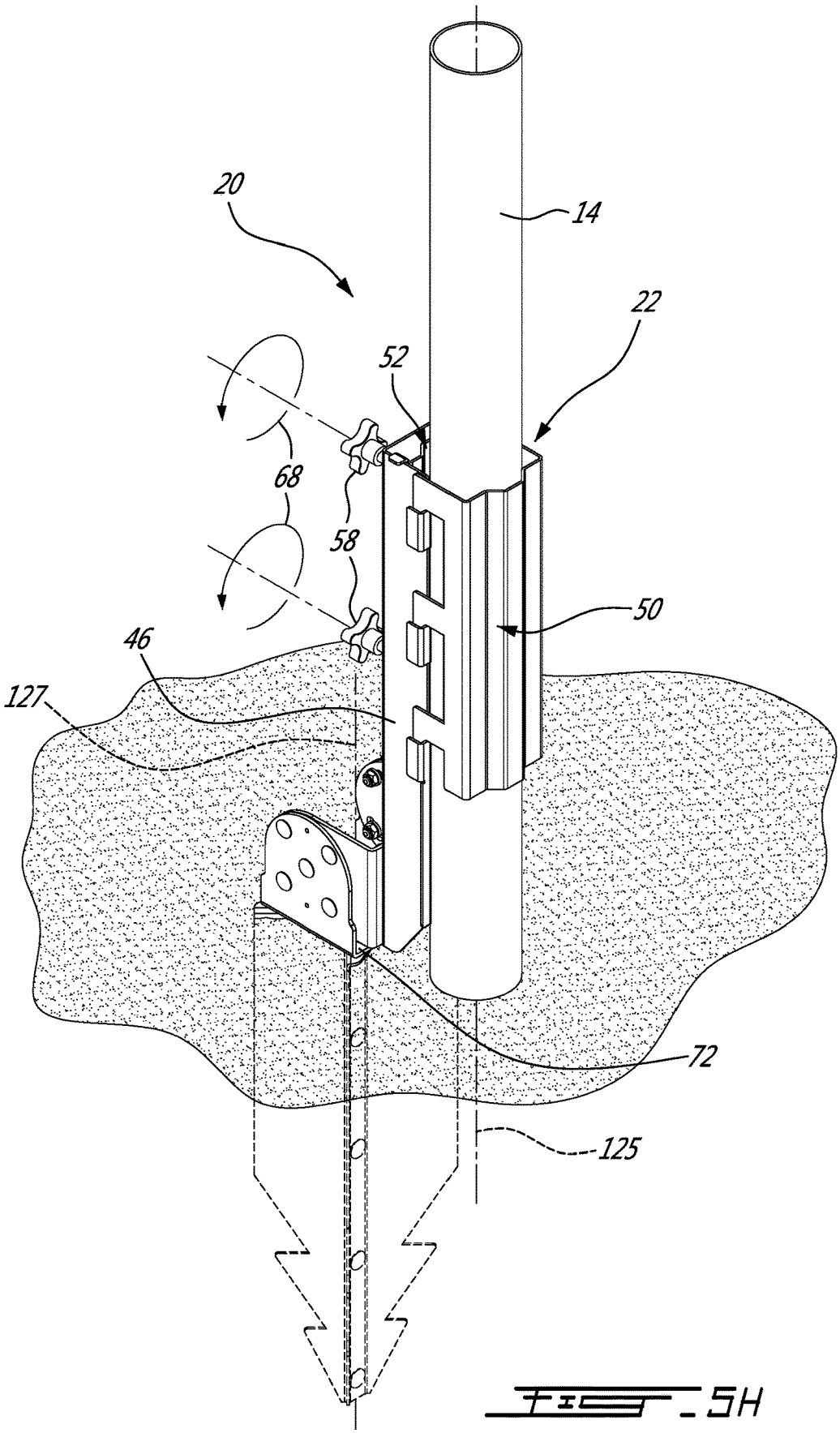

With references to FIGS. 5G and 5H, in operation of the tightening system 24, the pressure plate 52 is inserted in the sleeve 22 (see arrow 66) after the basketball hoop pole 14 is inserted therein and the cover 50 is attached. Then, both screws 58 are tightened (see arrow 68) to force a tight contact between the plate 52, pole 14 and cover 50.

The tightening system 24 allows securing the basketball hoop pole 14 into the pole sleeve 22 in a solidary parallel relationship therebetween.

According to another embodiment (not shown), a different number than two (2) clamping screws 58 can be provided in the tightening system 24.

According to the illustrated embodiment, the pole sleeve 22, including the pressure plate 52 therein, has an inner diameter that is sufficient to accommodate a round or rectangular pole having a diameter between 2½ inches (6.4 cm) and 4 inches (10.2 cm), which are standard diameters for conventional basketball hoop poles.

The adjustable mounting brackets 26 comprises a first mounting element 70 defining a first mounting portion 72 for mounting the adjustable mounting bracket 26 to the stake 28, and a second mounting element 74 that is secured to the first mounting element 70 and that includes a second mounting portion 76, for mounting the pole sleeve 22 to the adjustable mounting bracket 26.

Both mounting elements 70 and 74 are in the form of a U-shaped bracket having lateral side portions 78-80 and 82-84 that extends respectively from the first and second mounting portions 72 and 76 on opposite side edges perpendicularly therefrom.

The mounting portion 72 of the first mounting element 70 includes four (4) fastener-receiving holes (only three shown) 86 that are registered with the holes 44 of the stake 28 and that allows securing the first mounting element 70 thereto in a generally parallel relationship using fasteners such as bolts 88 and nuts 90.

The lateral side portions 78 and 80 have rounded distal edges and includes fastener-receiving holes 92 for mounting the second mounting element 74 thereto via its respective lateral side portions 82-84 using fasteners such as bolts and nuts 88-90.

The lateral side portions 82 and 84 of the second mounting element 74 includes arcuate holes 98 that are each registered with a respective hole 92 when the portions 82-84 are inserted between the lateral side portions 78-80 such that the mounting portion 76 is generally perpendicular to the mounting portion 72.

Fasteners such as bolts 88 and nuts 90 can be used to secure the second mounting element 74 to the first mounting element 70. Since the holes 98 in the second mounting element are arcuate, they allow a range of relative angular positions between both elements 70 and 74 about a pivot axis 100 that is generally parallel to the mounting portion 72 and generally perpendicular to the lateral side portions 78-84. This range of relative angular positions allows adjusting the angle of the mounting portion 76 relative to the mounting portion 72. A person skilled in the art will now appreciate that such an adjusting mechanism allows compensating a small tilt of the mounting portion 72 about the axis 100 and therefore of the stake 28 when levelling the holder 20.

The channel 46 of the pole sleeve 22 includes fastener-receiving holes 10 for securing the channel 46 to the second mounting element 74 of the mounting bracket 26 using fasteners such as bolts 88 and nuts 90. For such purpose, the mounting portion 76 of the second mounting element 74 is provided with arcuate fastener-receiving holes 102, thereby allowing a range of second relative angular positions between the channel 46 of the pole sleeve 22 and the second mounting element 74 about the pivot axis 104. The pivot axis 104 is generally parallel to the mounting portion 72 and generally perpendicular to both the second mounting portion 76 and the pivot axis 100. This range of second relative angular positions allows compensating a small tilt of the mounting portion 72 about the axis 104 and therefore of the stake 28 when levelling the holder 20.

The range of angular positions between each of the first and second pivot axes 100 and 104 is about 15° in both directions for a total range of 30° for each axis. According to another embodiment, the pivotal range is different for one or both of the pivot axes 100 and 104.

The adjustable mounting bracket 26 is not limited to the illustrated embodiment. For example, other elements than the arcuate holes 98 and 102 can be provided to allow a range of angular positions between the first and second mounting elements 70 and 74, such as a plurality of adjacent holes (not shown).

Another locking mechanism than bolts and nuts can be used to fixedly assemble the two mounting elements 70 and 74 in a selected relative angular position therebetween.

Also, the arcuate holes 98 can be provided on the first mounting element 70 instead/or additionally than on the second 74 and/or the arcuate holes 102 can be provided on the open channel 46 instead or additionally than on the second mounting element 74.

The mounting and lateral side portions 72 and 76-84 are not limited to being flat portions.

The installation of the pole holder 20 will now be described with reference to FIGS. 5A to 5F.

With reference to FIG. 5A, the first mounting element 70 is first secured to the stake 28 by attaching the mounting portion 72 to the receiving surface defined by the folds 42 using fastening elements 88-90. The stake 28 is then driven onto the ground 106 (see arrow 108) using a sledgehammer or a similar tool (not shown).

It is to be noted that the stake 28 can be alternatively driven into the ground 106 prior to the first mounting element being attached thereto.

The channel 46 of the pole sleeve 22 is then assembled to the first mounting element 70 via the second mounting element 74.

Before tightening the fasteners that attach the second mounting element 74 to the first mounting element 70 and those that attach the channel 46 to the second mounting element 74, the verticality of the channel 46 is first adjusted using a leveller 110 or any similar tool.

With reference to FIG. 5B, the front back alignment is adjusted using the leveller 110 by tilting the channel 46 about the axis 100 (see arrows 112 and 114). When the desired vertical alignment is reached, the nuts 90 of the fasteners between the first and second mounting element 70 and 74 are tight to fix the relative angular positions between both elements 70 and 74.

With reference to FIG. 5C, a similar adjustment is done to the relative angular positions between the channel 46 and the second mounting element 74 by pivoting the channel 46 about the axis 104 (see arrows 116 and 118) until verticality is achieved, as indicated by the leveller 110. The fasteners 88-90 between the channel 46 and second mounting element 74 are then tighten.

With references to FIGS. 5D and 5E, the basketball hoop pole 14 is then abutted with the intersection of the ground 106 and channel 46 and then tilted up (see arrow 120) in place within the channel 46.

The cover 50 is then mounted onto the channel 46 by inserted the tabs 22 within the lodgings 56 of the channel 46 (see arrow 122 in FIG. 5F).

At this point, the pole 14 is free to move up and down within the sleeve 22 and the gravity forces the pole 14 into contact with the ground.

It is to be noted that the mounting distance of the pole holder 20 relative to the ground 106 is of no consequence in most installations considering that the pole 14 can be mounted in the holder 20 so that its bottom end 124 contacts the ground 106.

As illustrated in FIGS. 5G and 5H and as explained hereinabove, the pressure plate 52 is then inserted in the sleeve 22 between the channel 46 and the pole 14 (see arrow 66) until the stops 62 is in contact with the top edge 64 of the channel 46. The clamping screws 58 are then rotated clockwise (see arrow 68 in FIG. 5H) to force a tight contact of the plate 52 onto the pole 14 and the pole 14 unto the cover 50.

The resulting installation of the basketball hoop pole 14 with backboard 12 and hoops 130 has been found to be sturdy and rigid with the pole 14 solidary with the post 68, even when an adult player hangs onto the hoops (not shown).

The uninstallation of the pole 14 and of the pole holder 20 can be achieved easily by reversing the above-mentioned installation steps. A lever or any suitable tool can be used to force the stake 28 out of the ground. The complete installation and uninstallation were each found to be achievable in less than 15 minutes.

A person skilled in the art will now appreciate that the configuration of the adjustable mounting bracket 26 yields an offset of the axis 125 defined by the pole 14, once installed, and of an axis 127 perpendicular to the center of the first mounting portion 72 (see FIG. 5H). This results in better stability of an installed pole 14, considering the weight of the board 12 is applied on the ground in front of the mounting bracket 26 and not directly on the mounting bracket 26. This is a consequence of the two mounting portions 72 and 76 being generally perpendicular, and of the mounting of the sleeve 22 on a side of the second mounting portion 76 opposite the first mounting portion 72.

As a further advantage, most of the parts of the pole holder 20 were manufactured from pieces laser cut or stamped in a single sheet of steel (not shown). The pieces are then bent to the illustrated shapes and then assembled using fasteners. This has been found to minimize the manufacturing costs of the holder. According to the first illustrated embodiment, the parts of the holder 20 are cut in a 3 mm thick sheet of steel. A pole holder according to another illustrative embodiment can however be manufactured using another process.

Figure 7:
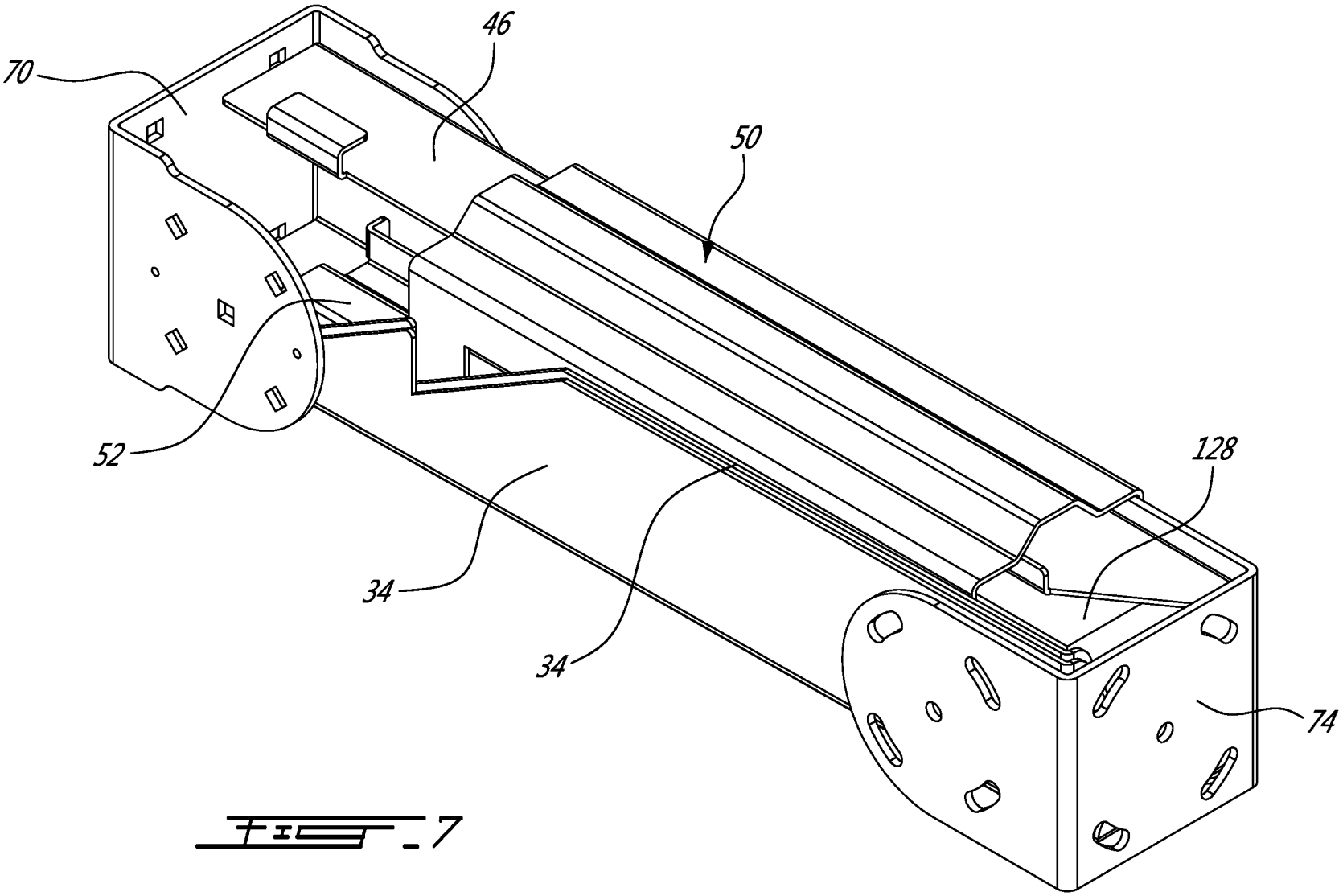
FIG. 7 is a perspective view of the parts of the basketball hoop pole holder from FIG. 2, shown assembled in a compact configuration suitable for shipping.

As shown in FIG. 7, the parts 34, 46, 50, 52, 70 and 74 are configured and sized to be assembled in a compact generally rectangular parallelepiped shaped to minimize its shipment volume. While in such a configuration, the holder 20 can be inserted in a correspondingly shaped and dimensioned box (not shown). The fastener parts 60, 88 and 90 can be put in a box 128) or bag (not shown) and inserted within the arrangement for easy shipping.

To achieve the arrangement shown in FIG. 7, both halves 34 of the stake 28 are first stacked in a complementary way. Then, they are longitudinally inserted in the channel 46. It is to be noted that the channel 46 is both longer and wider than the halves 34. The first and second mounting elements 70 and 74 are then positioned at respective longitudinal ends of the resulting assembly. with the first and second mounting portions 72 and 76 defining the longitudinal ends of the arrangement. The distance between both lateral sides 78-80 and 82-84 is sufficient to include both halves 34 of the stake 28 and the channel 46 therebetween. The plate 52 is then inserted within the resulting box-like arrangement and the cover 50 is then positioned to partially closed said box. More specifically, tabs 51 from a first side thereof are positioned on the interior side of the halves 34 of the stake 28 and tabs form the other side are positioned outside the channel 46. According to the first illustrated embodiment, the dimension of this shipping configuration is 6 inches by 6 inches by 27 inches (150 mm×150 mm×680 mm).

Figure 6:
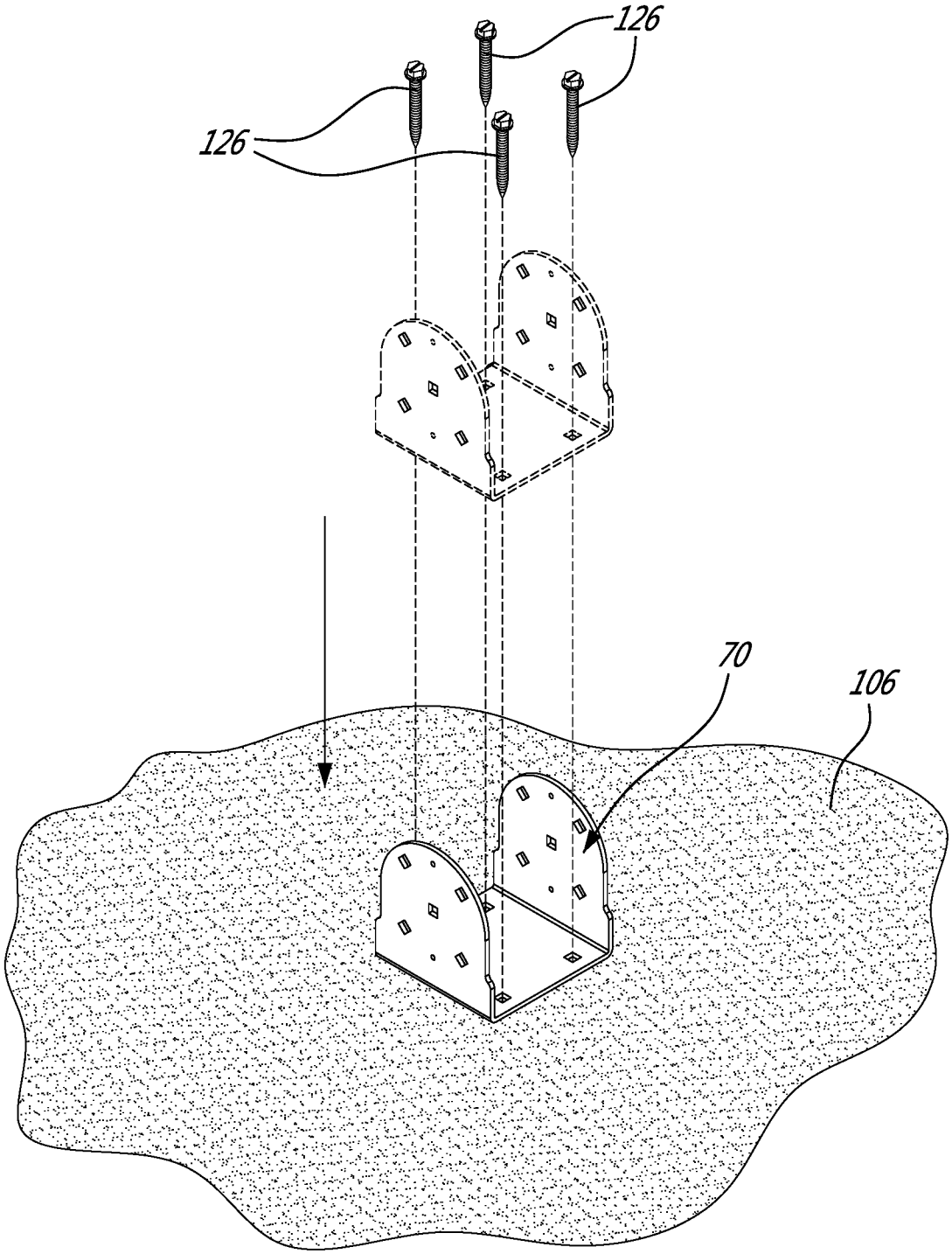
FIG. 6 is a perspective view similar to FIG. 5A, illustrating the mounting of the adjustable bracket directly onto the ground.

It is to be noted that many modifications could be made to the pole holder 20 described hereinabove and illustrated in the appended drawings. For example:

- as shown in FIG. 6, the stake 28 can be omitted in cases where the first mounting element 70 can be directly secured to the ground 106. Such can be the case, for example, on a hard ground such as one made of concrete or asphalt. Appropriate fasteners, such as concrete screws 126 are then used;
- some or all of the pieces of the holder 20 can be fixedly assembled using other means than fasteners, such as for example welding, for example in the case of a semi-permanent assembly;
- the pole receiving channel of the pole sleeve is not limited to a rectangular section and the longitudinal opening thereof can be limited to only a portion of the length of the channel;
- the pole sleeve can be adapted to receive a rectangular pole or any other differently shaped pole than a cylindrical one;
- the configurations of the cover of the pole sleeve and of the pressure plate can be different than illustrated. The length of the cover and/or of the pressure plate can also be smaller than the length of the channel so as to cover only a portion thereof.
- the pole sleeve can be already closed and therefore be configured without a removable cover. In such, a case, the pole is inserted longitudinally through one of its opening ends;
- the pressure plate can be omitted. In such a case, the end of the clamping screws 58 can be provided with an arcuate portion to contribute distributing the pressure of the screw 58 on the pole 14;
- the removable basketball hoop pole holder can be made of other material than steel, such as graphene, aluminum, fiber glass, etc.

It is to be noted that a basketball hoop with pole from a conventional portable or permanently fixed system can be recycled and used in connection with a pole holder according to an illustrative embodiment to form a portable basketball hoop system as described herein.

While the illustrative embodiments of a pole holder have been described with reference to a basketball hoop pole, such holders can be used to attach other types of poles to a structure, such as without limitations volleyball or badminton net posts, traffic signages, light signals, advertisement signages, etc.

Although a pole holder has been described hereinabove by way of illustrated embodiments thereof, it can be modified. It is therefore to be understood that numerous modifications may be made to the illustrative embodiments and that the scope of the claims should not be limited by the preferred embodiment, but should be given the broadest interpretation consistent with the description as a whole.

What is claimed is:

1. A holder for a pole comprising:

a pole sleeve for receiving the pole; the pole sleeve defining a first axis;

a tightening system for securing the pole into the pole sleeve in a solidary relationship between the pole and the pole sleeve; and an adjustable mounting bracket having:

a first mounting element defining a first mounting surface for mounting the adjustable mounting bracket to another surface in a generally parallel relationship, and a second mounting element being fixedly mountable to the first mounting element within a first range of relative angular positions therebetween about a second axis that is generally parallel to the first mounting surface; the second mounting element defining a second mounting surface for fixedly receiving the pole sleeve in a generally parallel relationship within a second range of relative angular positions therebetween about a third axis that is generally perpendicular to the second mounting surface and to the second axis;

wherein the pole sleeve, and the first and second mounting elements are configured and sized to be removably assembled together in a generally rectangular parallelepiped.

2. The holder as recited in claim 1, wherein the pole sleeve includes i) a channel having a longitudinal opening along the first axis for receiving the pole, and ii) a removable cover that cooperates with the channel to close the longitudinal opening.

3. The holder as recited in claim 2, wherein the longitudinal opening extends along a full length of the sleeve.

4. The holder as recited in claim 2, wherein the removable cover and the channel have substantially a same length.

5. The holder as recited in claim 2, wherein the removable cover and the channel have respective first and second cooperating elements for attaching the cover to the channel.

6. The holder as recited in claim 5, wherein one of the first and second cooperating elements are tabs and the other are respective tab-receiving lodgings.

7. The holder as recited in claim 1, wherein the tightening system includes at least one screw operatively mounted through the channel for applying selective pressure onto the pole when the pole is received within the pole sleeve.

8. The holder as recited in claim 7, wherein the tightening system further includes a pressure plate that is insertable within the sleeve between the pole when the pole is inserted in the sleeve and the channel of the sleeve.

9. The holder as recited in claim 8, wherein the pressure plate has longitudinal ends and mechanical stops at one of the longitudinal ends for abutment with a longitudinal edge of the pole sleeve.

10. The holder as recited in claim 1, further comprising a stake for insertion into a ground; the stake defining a fourth axis and having a mounting surface that is generally perpendicular to the fourth axis for receiving the first mounting surface of the adjustable mounting bracket.

11. The holder as recited in claim 10, wherein the fourth axis is offset relative to the first axis.

12. The holder as recited in claim 10, wherein the stake is assembled from two identical parts.

13. The holder as recited in claim 12, wherein the pole sleeve, the adjustable mounting bracket and the stake are assembled from bended pieces of at least one sheet of steel.

14. The holder as recited in claim 12, wherein the pole sleeve includes a) a channel having a longitudinal opening along the first axis for receiving the pole, and b) a removable cover that cooperates with the channel to close the longitudinal opening; the first and second mounting elements being generally U-shaped; the generally rectangular parallelepiped being defined by:

a. the two identical parts of the stake being stacked in a complementary way, resulting in a stack;

b. the stack being inserted in the channel of the pole sleeve;

c. the first and second mounting elements being positioned at a respective longitudinal end of the channel, yielding an open generally box shaped arrangement;

d. the cover being inserted onto the generally box shaped arrangement so as to at least partially close the generally box shaped arrangement.

15. The holder as recited in claim 1, wherein each of the first and second mounting elements is a U-shaped bracket having respective first and second mounting portions and two lateral side portions extending on opposite sides of the respective first and second mounting portions; the first and second mounting surfaces being on the respective first and second mounting portions; the first and second mounting elements being assembled via their respective lateral side portions.

16. The holder as recited in claim 15, wherein the lateral side portions are configured to allow the first range of relative angular positions between the first and second mounting elements.

17. The holder as recited in claim 16, wherein the lateral side portions include fastener-receiving holes; wherein each of the lateral side portions of one of the first and second mounting elements is secured using fasteners to a respective lateral side portions of another one of the first and second mounting elements via the fastener-receiving holes.

18. The holder as recited in claim 17, wherein the fastener-receiving holes on one of the first and second mounting elements are arcuate to allow the first range of relative angular positions.

19. The holder as recited in claim 1, wherein the second mounting surface and the pole sleeve are configured for cooperation to allow the second range of relative angular positions therebetween.

20. The holder as recited in claim 19, wherein the second mounting surface and the pole sleeve both includes fastener-receiving holes.

21. The holder as recited in claim 20, wherein the fastener-receiving holes on one of second mounting surface and on the pole sleeve are arcuate to allow the second range of angular positions.

22. The holder as recited in claim 1, wherein the pole sleeve and the adjustable mounting bracket are assembled from bended pieces of at least one sheet of steel.

23. A holder for a pole comprising:

a pole sleeve for receiving the pole;

a tightening system for securing the pole into the pole sleeve in a solidary relationship between the pole and the pole sleeve; and a mounting bracket including:

a first mounting element having a first mounting surface for mounting the mounting bracket to another surface in a generally parallel relationship between the first mounting surface and said another surface, and a second mounting element secured to the first mounting element and having a second mounting surface that is generally perpendicular to the first mounting surface for fixedly receiving the pole sleeve in a generally parallel relationship between the pole sleeve and the second mounting surface, such that the pole sleeve is offset from the first mounting surface;

wherein each of the first and second mounting elements is a U-shaped bracket including the respective first and second mounting surfaces and two lateral side portions extending on opposite sides of the respective first and second mounting surfaces; the first and second mounting elements being assembled via their respective lateral side portions.

24. A holder for a pole comprising:

a pole sleeve for receiving the pole;

a tightening system for securing the pole into the pole sleeve in a solidary relationship between the pole and the pole sleeve; and a mounting bracket including:

a first mounting element having a first mounting surface for mounting the mounting bracket to another surface in a generally parallel relationship between the first mounting surface and said another surface, and a second mounting element secured to the first mounting element and having a second mounting surface that is generally perpendicular to the first mounting surface for fixedly receiving the pole sleeve in a generally parallel relationship between the pole sleeve and the second mounting surface, such that the pole sleeve is offset from the first mounting surface; wherein the pole sleeve includes i) a channel having a side opening for receiving the pole, and ii) a removable cover that cooperates with the channel to close the side opening.

25. The holder as recited in claim 23, wherein the tightening system includes at least one screw operatively mounted through the channel for applying selective pressure onto the pole when it is received within the pole sleeve.

26. The holder as recited in claim 23, further comprising a stake for insertion into a ground; the stake defining a first axis and having a mounting surface that is generally perpendicular to the first axis for removably receiving the first mounting surface of the mounting bracket.

27. A holder for a pole comprising:

a pole sleeve for receiving the pole;

a tightening system for securing the pole into the pole sleeve in a solidary relationship between the pole and the pole sleeve; and a mounting bracket including:

a first mounting element having a first mounting surface for mounting the mounting bracket to another surface in a generally parallel relationship between the first mounting surface and said another surface, and a second mounting element secured to the first mounting element and having a second mounting surface that is generally perpendicular to the first mounting surface for fixedly receiving the pole sleeve in a generally parallel relationship between the pole sleeve and the second mounting surface, such that the pole sleeve is offset from the first mounting surface; wherein both the pole sleeve and the mounting bracket are assembled from bended pieces of at least one sheet of steel.

28. A holder for a pole comprising:

a pole sleeve for receiving the pole; the pole sleeve defining a first axis;

a tightening system for securing the pole into the pole sleeve in a solidary relationship between the pole and the pole sleeve; and an adjustable mounting bracket including:

a first mounting element having a first mounting portion for mounting the mounting bracket to a surface in a generally parallel relationship between the first mounting portion and the horizontal surface;

a stake for insertion into a ground; the stake defining a second axis and having a mounting surface that is generally perpendicular to the second axis for receiving the first mounting portion of the adjustable mounting bracket; and a second mounting element being fixedly mountable to the first mounting element within a first range of relative angular positions therebetween about a third axis that is generally parallel to the first mounting portion and generally perpendicular to the second axis; the second mounting element defining a second mounting portion for fixedly receiving the pole sleeve in a generally parallel relationship within a second range of relative angular positions therebetween about a fourth axis that is generally perpendicular to the second mounting surface and to the third axis; the pole sleeve being offset from the first mounting portion.

* * * * *